US010413045B2

(12) United States Patent
Crisp

(10) Patent No.: US 10,413,045 B2
(45) Date of Patent: Sep. 17, 2019

(54) HARD SHELL BACKPACK

(71) Applicant: Valerie Crisp, Toronto (CA)

(72) Inventor: Valerie Crisp, Toronto (CA)

(73) Assignee: Valerie Crisp, Toronto, Ontario ( * ) Notice: Subject to any disclaimer, the term of this patent is extended or adjusted under 35 U.S.C. 154(b) by 0 days.

(21) Appl. No.: 15/813,251

(22) Filed: Nov. 15, 2017

(65) Prior Publication Data

US 2019/0142141 A1 May 16, 2019

(51) Int. Cl.
*A45F 3/04* (2006.01)

(52) U.S. Cl.
CPC ..... *A45F 3/04* (2013.01)

(58) Field of Classification Search
CPC ... A45F 3/04; A45F 3/08; A45C 11/20; E05Y 2900/602; Y10T 16/53843
USPC ..... 224/628, 629
See application file for complete search history.

(56) References Cited

U.S. PATENT DOCUMENTS

| | | | | |
|---|---|---|---|---|
| D392,094 | S | 3/1998 | Lane | |
| 6,474,524 | B1 * | 11/2002 | Ivarson | A45F 3/04 224/637 |
| 7,165,705 | B2 * | 1/2007 | Haro | A45C 13/04 224/627 |
| 8,672,202 | B2 | 3/2014 | Tayar | |
| D725,377 | S | 3/2015 | Simmons | |
| 9,332,852 | B1 * | 5/2016 | Milich | A47C 13/00 |
| 2005/0098598 | A1 * | 5/2005 | Kuhn | A45C 11/20 224/629 |
| 2006/0144841 | A1 * | 7/2006 | Sener | A45C 11/20 220/521 |
| 2015/0173490 | A1 | 6/2015 | Talmo | |

FOREIGN PATENT DOCUMENTS

| | | | |
|---|---|---|---|
| CA | 2385481 | A1 | 11/2002 |
| DE | 202004015475 | U1 | 2/2005 |
| FR | 2660170 | A1 | 3/1990 |
| WO | 2004021828 | A1 | 3/2004 |
| WO | 2015013700 | A1 | 1/2015 |

* cited by examiner

*Primary Examiner* — Adam J Waggenspack
(74) *Attorney, Agent, or Firm* — Norton Rose Fulbright Canada LLP

(57) ABSTRACT

The invention provides a backpack comprising: a shell having: a back wall; a bottom wall; a left side wall; a right side wall; and a front wall, the front wall having a height less than a height of the back wall, wherein an opening is defined between upper edges of the back wall, the side walls and the front wall; a cover having a periphery engaging the upper edges and covering the opening in a closed position; a pair of lower arms and a pair of upper arms, each arm having a proximal end pivotally mounted to one of: the right side wall; and the left side wall and a distal end pivotally mounted to one of: a right portion and a left portion of the cover respectively; and wherein a pair of four bar linkages are defined by the lower arms, the upper arms, the right and left side walls of the shell, and the right and left portions of the cover.

13 Claims, 9 Drawing Sheets

HARD SHELL BACKPACK

TECHNICAL FIELD

The invention relates to a backpack having a flexible plastic shell with an access opening to the interior compartment and a removable cover over the access opening that is mounted on linkage arms to form a four bar linkage mechanism.

BACKGROUND OF THE ART

The design of a backpack generally includes a flexible fabric body with shoulder support straps. The fabric body usually includes a large interior storage compartment accessible with various fasteners and smaller pockets accessible from the exterior. Water penetration of the fabric and impact can damage the contents such as laptop computers and paper books.

Backpacks with solid or semi-rigid shells provide superior protection for the contents but are more expensive, can be heavier and cannot expand or contract like a flexible fabric body. Hard shells are common in larger luggage designs and some manufacturers have extended the same design features to smaller carry on bags, handbags and back packs. Motorcycle back packs can be rigid to improve aerodynamics and to provide some back protection from wind, weather, debris and during accidents. Examples of hard shell backpacks are described in French Patent 2660170, U.S. Design Pat. 392094 and 725377.

Access to the contents of a back pack is usually accomplished by placing the back pack upright on a support surface and opening the top zipper or fasteners. The flexibility of a fabric backpack can create difficulties when inserting and removing larger items like laptops and books. A hard shell back pack can include zippers or fasteners or can include a hard cover hinged to the body with latches to provide access like larger luggage items.

Features that distinguish the present invention from the background art will be apparent from review of the disclosure, drawings and description of the invention presented below.

DISCLOSURE OF THE INVENTION

The invention provides a backpack comprising: a shell having: a back wall; a bottom wall; a left side wall; a right side wall; and a front wall, the front wall having a height less than a height of the back wall, wherein an opening is defined between upper edges of the back wall, the side walls and the front wall; a cover having a periphery engaging the upper edges and covering the opening in a closed position; a pair of lower arms and a pair of upper arms, each arm having a proximal end pivotally mounted to one of: the right side wall; and the left side wall and a distal end pivotally mounted to one of: a right portion and a left portion of the cover respectively; and wherein a pair of four bar linkages are defined by the lower arms, the upper arms, the right and left side walls of the shell, and the right and left portions of the cover.

DESCRIPTION OF THE DRAWINGS

In order that the invention may be readily understood, one embodiment of the invention is illustrated by way of example in the accompanying drawings.

Further details of the invention and its advantages will be apparent from the detailed description included below.

DETAILED DESCRIPTION OF PREFERRED EMBODIMENTS

Figure 9:
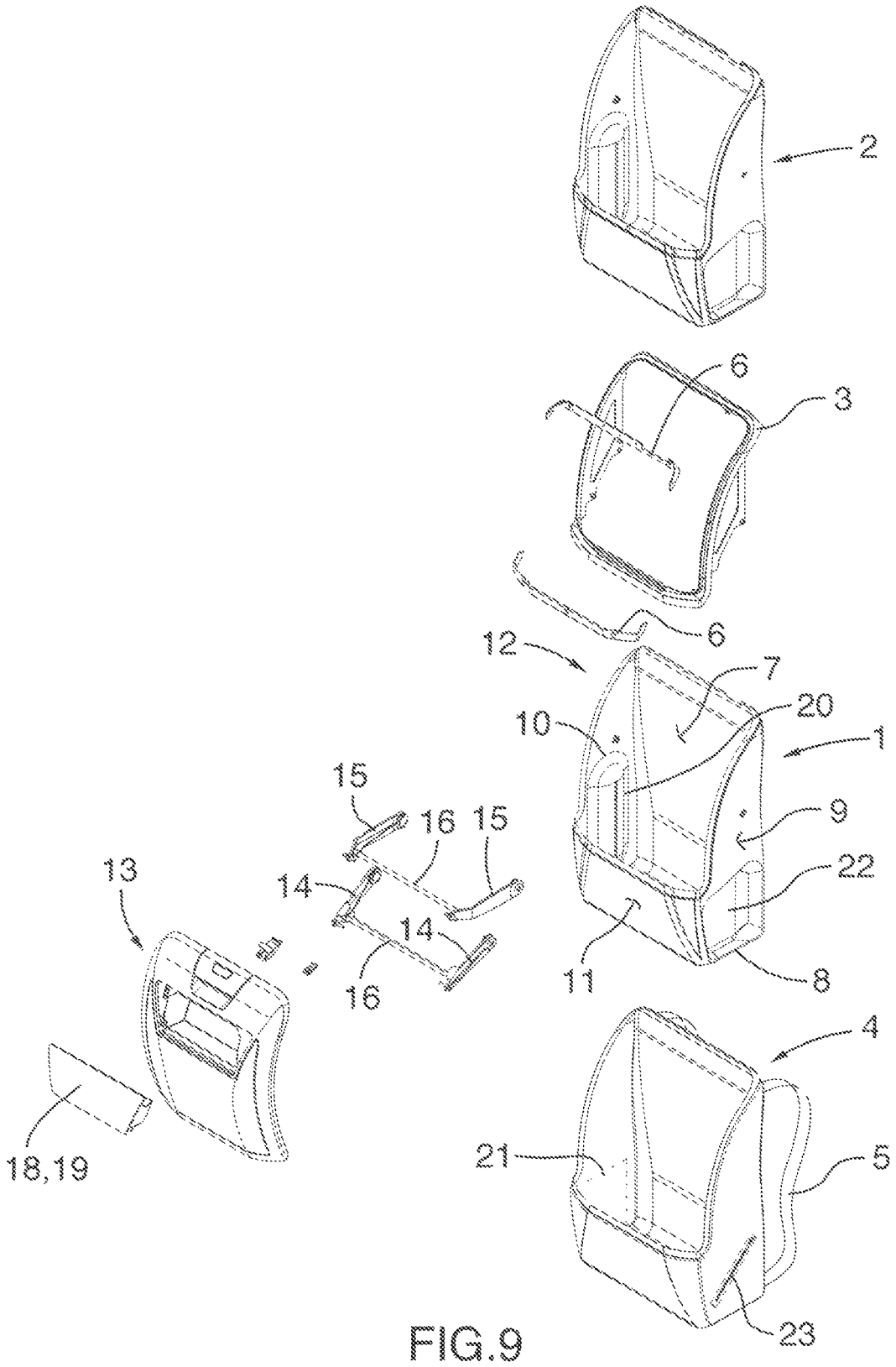
FIG. 9 is an exploded view of the components of the backpack.

FIG. 9 shows an exploded view of the back pack components that are assembled together. The shell 1 can be molded of flexible polypropylene and receives an interior liner 2 of rip-stop nylon fabric. The shell 1 also receives an exterior covering 4 of ballistic nylon fabric including shoulder support straps 5 (see FIG. 2). The shell 1, interior liner 2 and exterior covering 4 are secured together with adhesives, a main outer bezel 3 and inner bezel strips 6.

The shell 1 has: a back wall 7; a bottom wall 8; a left side wall 9; a right side wall 10; and a front wall 11. The front wall 11 has a height less than a height of the back wall 7 and the side walls 9, 10 taper from bottom to top. An access opening 12 is defined by the upper edge of the back wall 7, the upper edges of the side walls 9, 10 and the upper edge of the front wall 11 and the access opening is framed by the main outer bezel 3 when assembled.

The cover 13 has a periphery that matches and engages the main outer bezel 3 and upper edges surrounding the opening 12 and serves to cover the opening 12 in the closed position shown in FIGS. 1-2, and 5-8. In the open position shown in FIGS. 3-4 the cover 13 is withdrawn downwardly and access to the contents is provided through the top portion of the opening 12.

Figure 4:
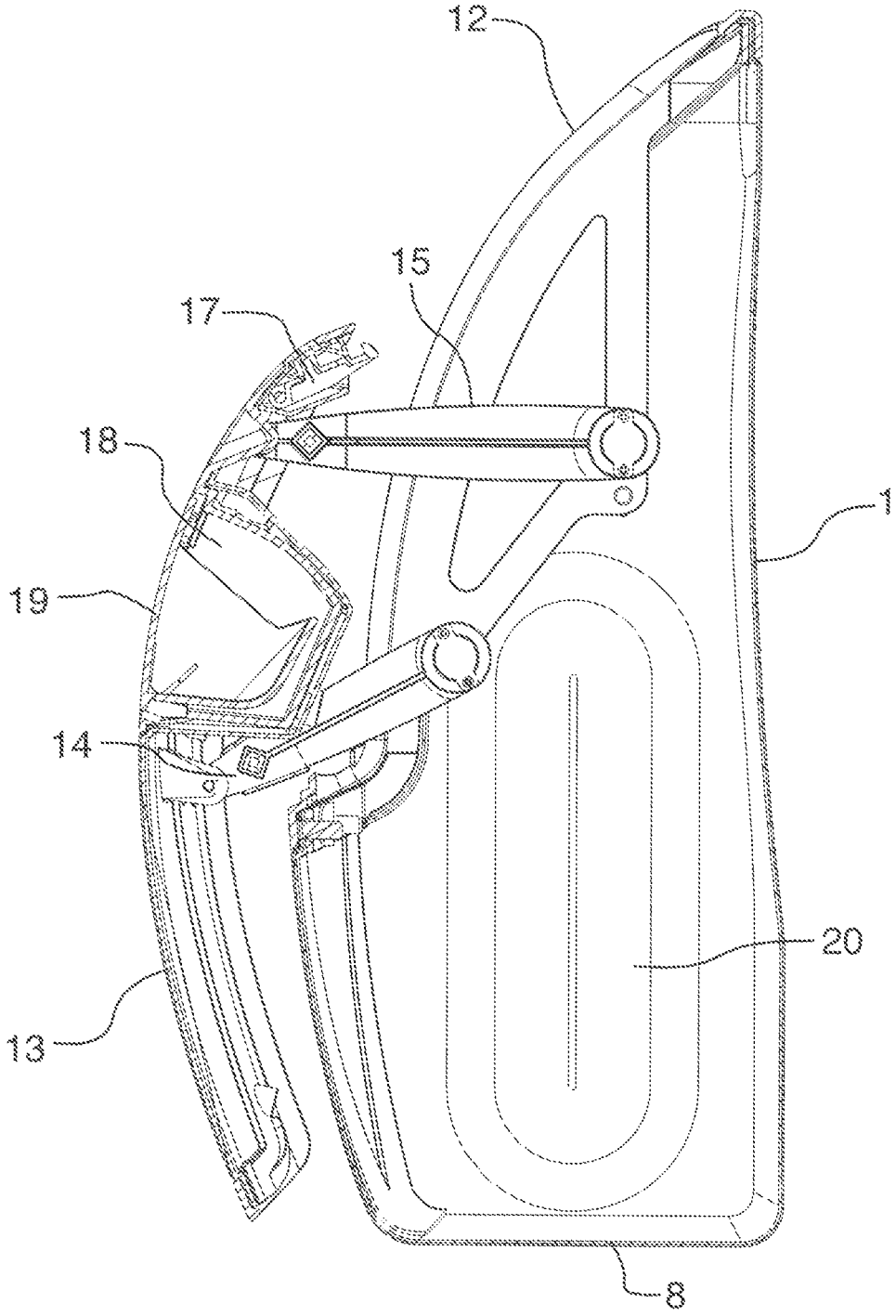
FIG. 4 is a vertical sectional view along the line 4-4 of FIG. 3.
Figure 5:
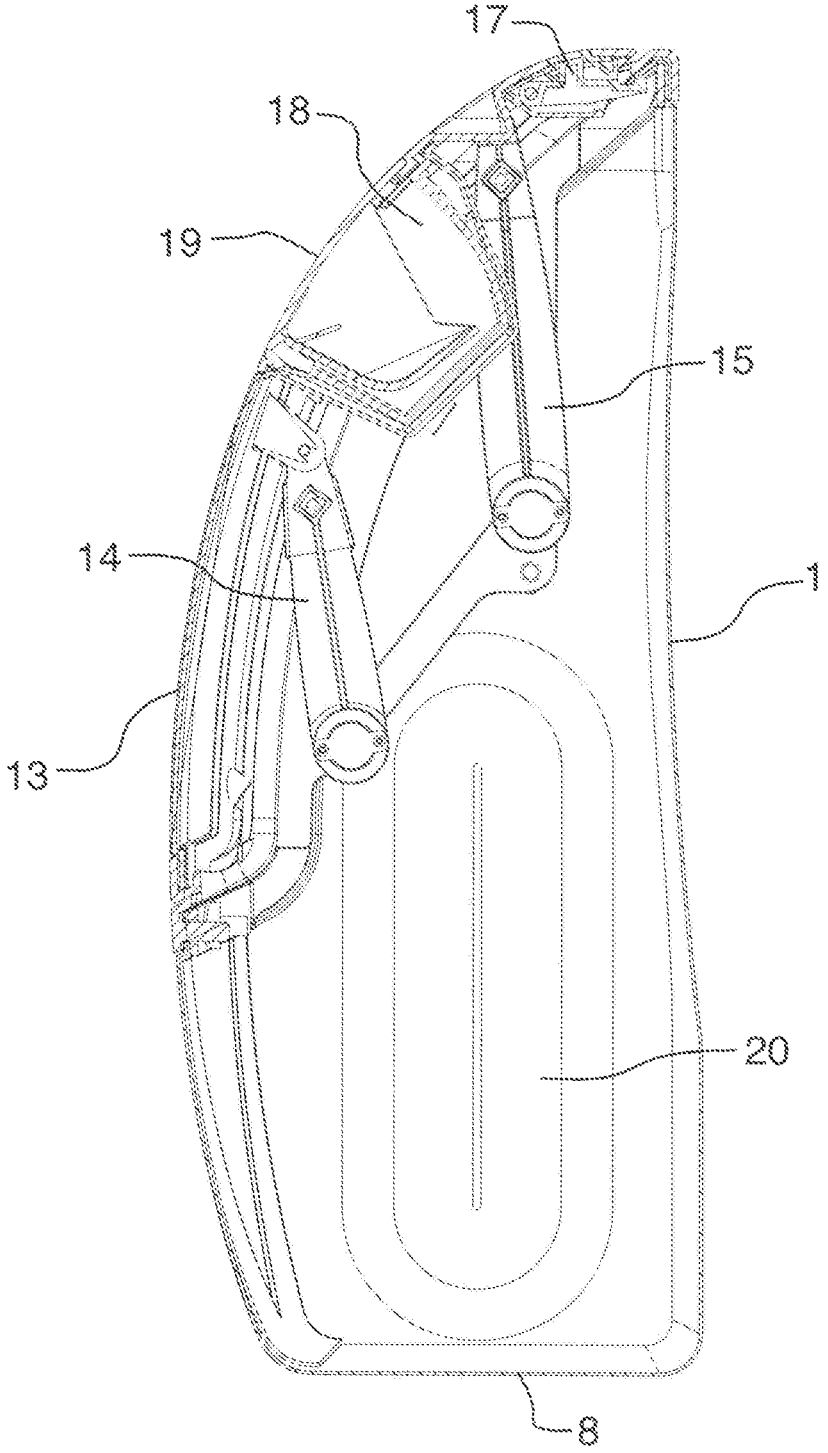
FIG. 5 is a vertical sectional view along the line 5-5 of FIG. 1.

As best seen in FIGS. 4-5, the cover 13 is releasably mounted to the shell 1 with pairs of lower linkage arms 14 and upper linkage arms 15. As seen in FIG. 9, a pair of lower arms 14 and a pair of upper arms 15 may be joined in a U-shape by lower and upper transverse members 16 which aids in assembly and provides added rigidity. Each arm 14, 15 has a proximal or inner end pivotally mounted to either the right side wall 10 or the left side wall 9.

As seen in FIGS. 4-5, each arm 14, 15 has a distal or outer end pivotally mounted to either a right portion or a left portion of the cover 13. Mechanically speaking, a left and right pair of four bar linkages are defined by the lower arms 14, the upper arms 15, the right and left side walls 10, 9 of the shell 1, and the right and left portions of the cover 13. The arms 14, 15 are fully hidden by the cover 13 in the closed position and do not significantly obstruct the opening 12 in the open position.

Figure 6:
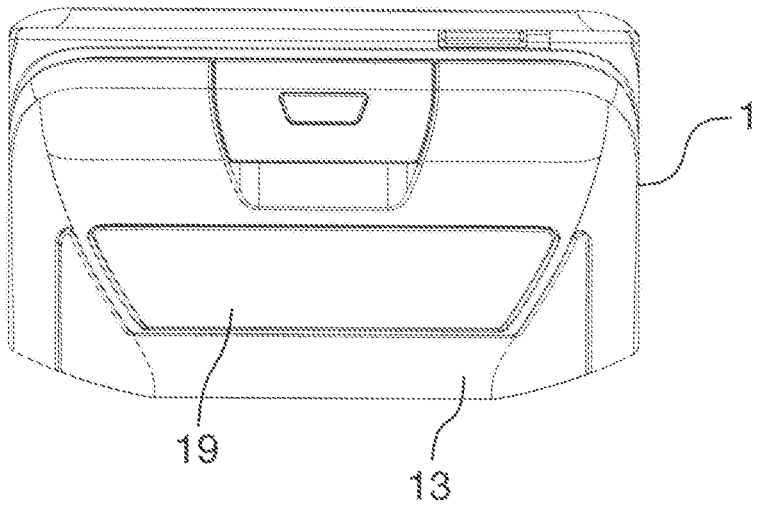
FIGS. 6, 7 and 8 are respectively a top view, a front view and a left side view of the shell and cover of FIG. 1 in the closed position.
Figure 7:
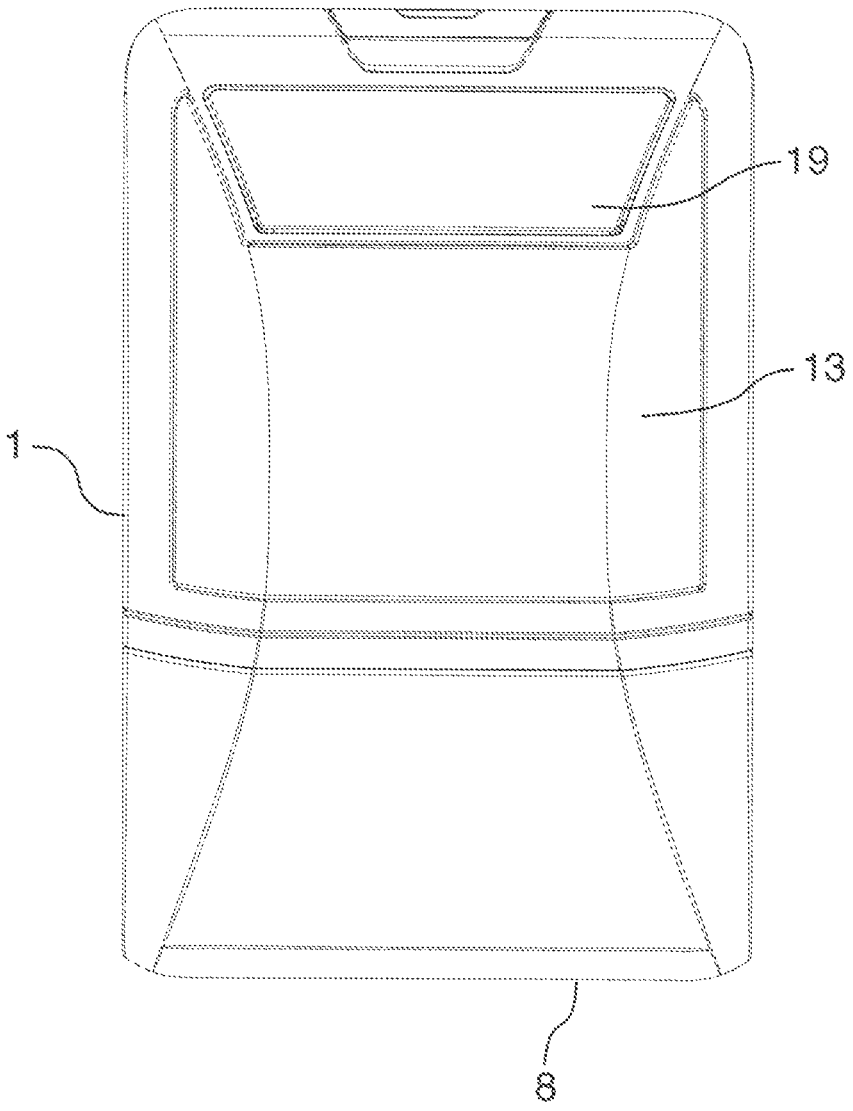
Figure 8:
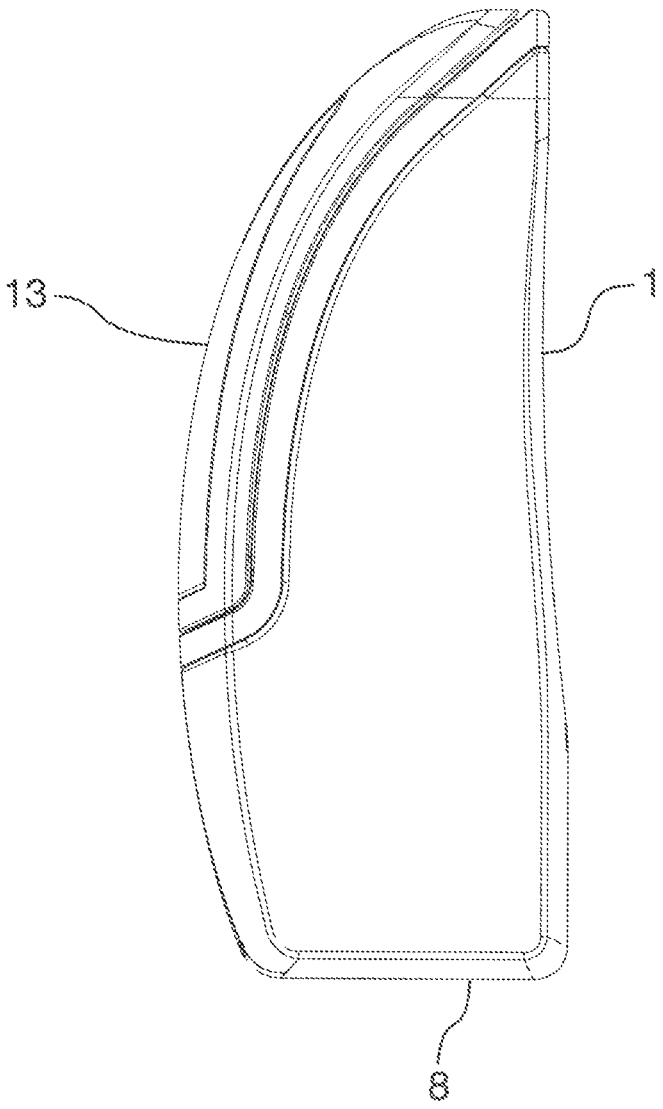

As seen in FIGS. 6-7, the bottom wall 8 of the shell 1 is substantially planar. Optionally the bottom wall 8 of the shell 1 can include at least three projections having lower ends defining a plane. In either case the bottom wall 8 allows the back pack to stand vertically on a flat surface such as a desk top or floor. The center of gravity of the backpack is located over the planar bottom wall 8, when empty or when full, which provides improved stability compared to a flexible fabric backpack that tends to collapse and fall over.

To protect the contents from water damage, the periphery of the cover 13 includes a water resistant seal. In the closed position (FIGS. 1, 5-8) the water resistant seal engages the main outer bezel 3 on the upper edges of the back wall 7, the side walls 9, 10 and the front wall 11. As seen in FIGS. 4-5, a latch 17 releasably connects the cover 13 to the shell 1 in the closed position. The cover 13 is spring biased to the open position of FIG. 4 when the latch 17 is released. For example a low profile coil spring can be mounted about the pivot points of the lower arms 14.

The cover 13 can include a storage compartment 18 accessible via an exterior hatch 19 to store small items such as sun glasses or memory thumb drives.

As seen in FIGS. 4-5 and 9, the shell 1 includes a bottle recess 20 in a lower portion of the right side wall 10 as illustrated, but could equally be located in the left side wall 9. The exterior fabric covering 4 includes a bottle storage pocket 21 adjacent the bottle recess 20.

Figure 1:
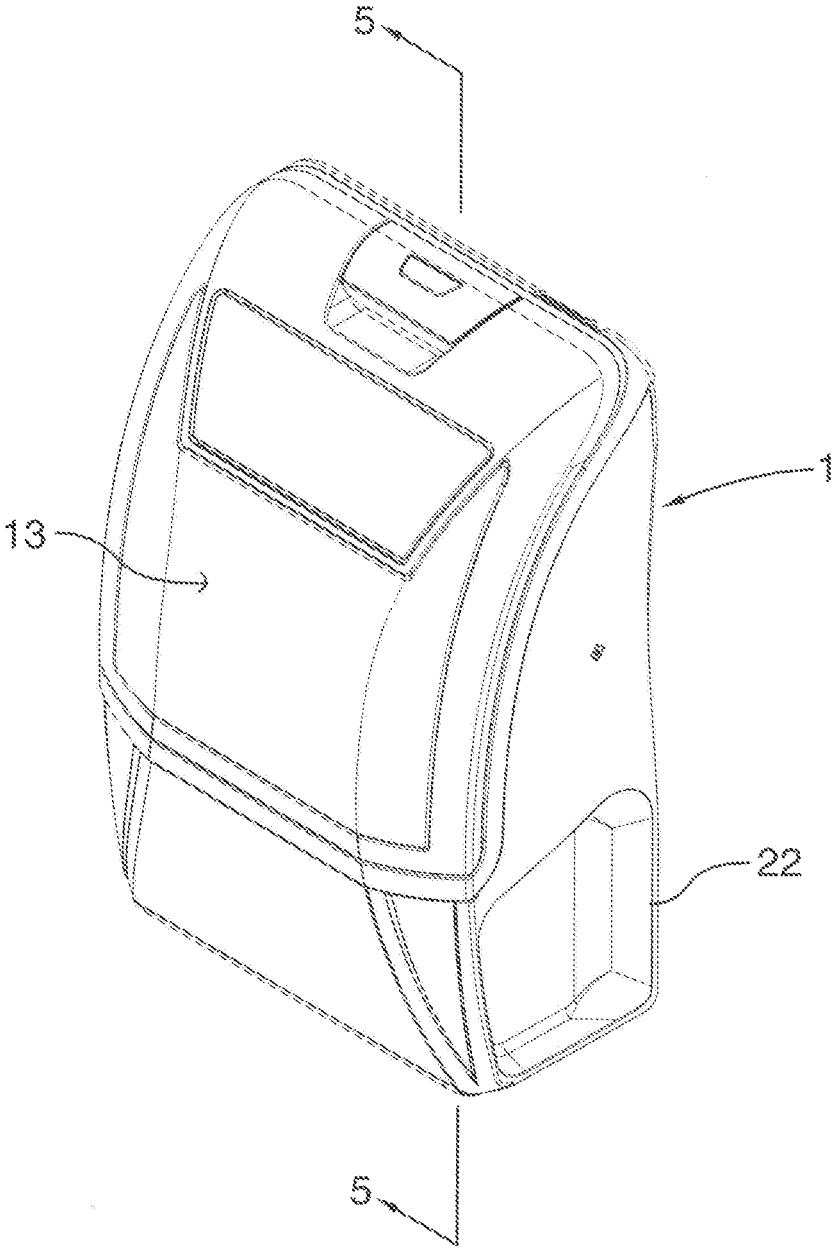
FIG. 1 is a front right perspective view of the shell and cover in the closed position.
Figure 2:
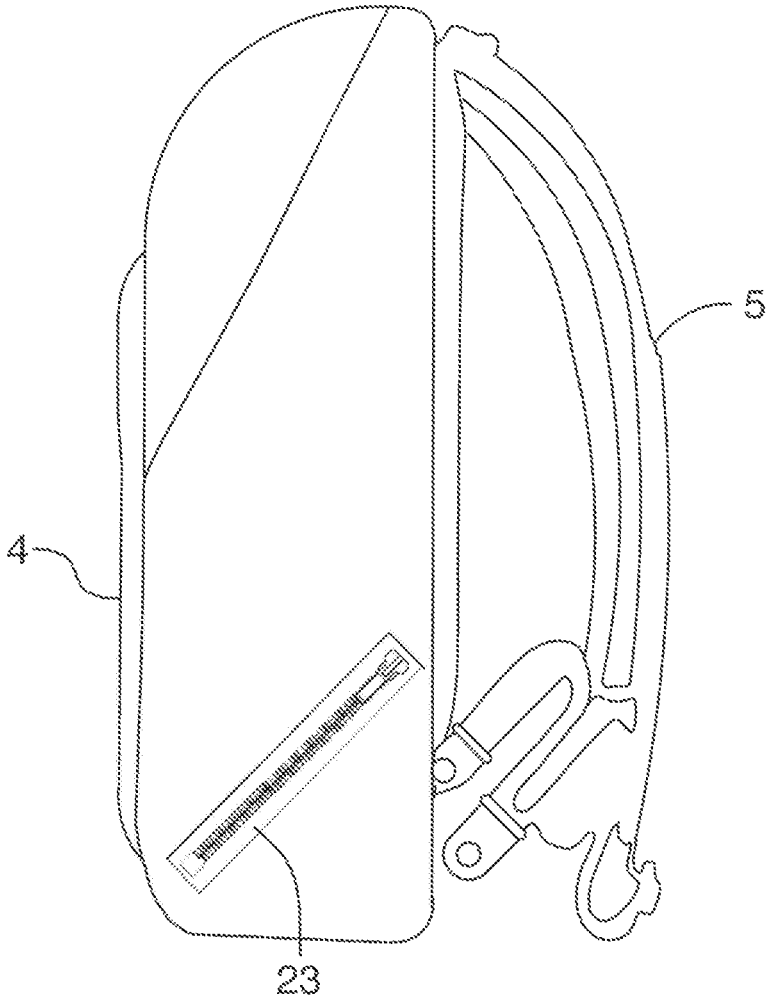
FIG. 2 is a left side view of the shell with the cover closed housed within an exterior fabric covering including shoulder support straps.
Figure 3:
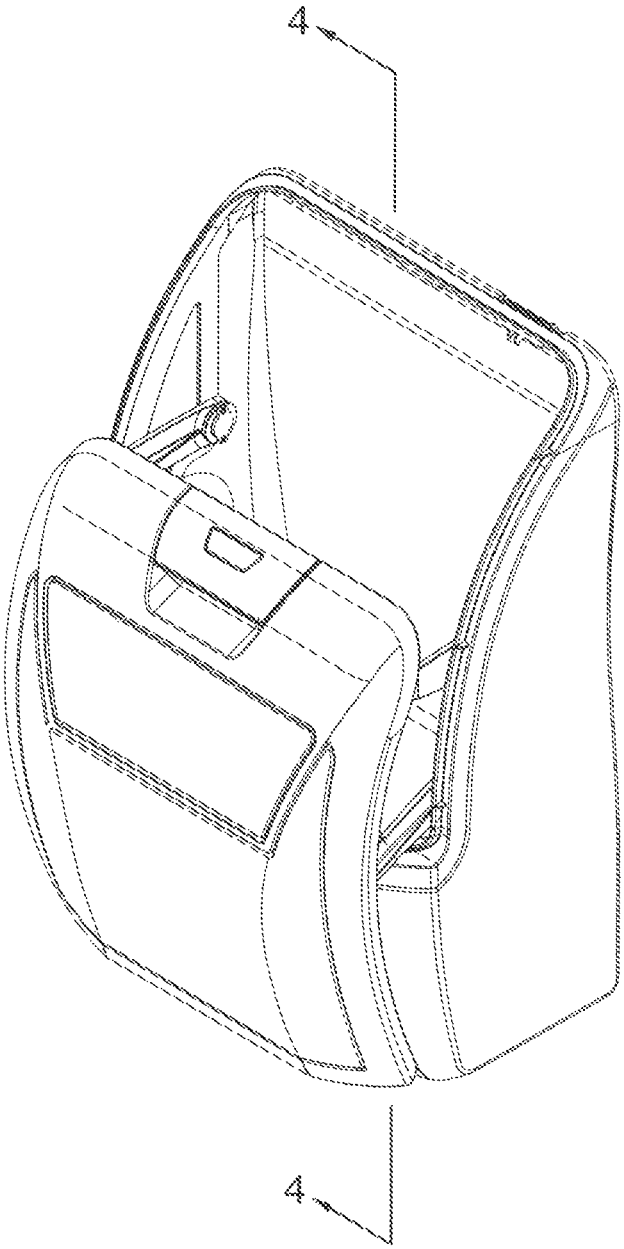
FIG. 3 is a front right perspective view of the shell and cover in the open position.

As seen in FIGS. 1 and 9, the shell 1 can include a storage recess 22 in a lower portion of the left side wall 9 as illustrated, but could equally be located in the right side wall 10. As seen in FIGS. 2 and 9 the exterior covering 4 includes a closeable pocket opening, such as a zipper 23, adjacent the storage recess 22 in the shell 1.

Although the above description relates to a specific preferred embodiment as presently contemplated by the inventor, it will be understood that the invention in its broad aspect includes mechanical and functional equivalents of the elements described herein.

I claim:

1. A backpack comprising:

a shell having: a back wall; a bottom wall; a left side wall; a right side wall; and a front wall, the front wall having a height less than a height of the back wall, wherein an opening is defined between upper edges of the back wall, the side walls and the front wall;

a cover having a periphery engaging the upper edges and covering the opening in a closed position; and a pair of lower arms and a pair of upper arms, each arm having a proximal end pivotally mounted to one of: the right side wall; and the left side wall and a distal end pivotally mounted to one of: a right portion and a left portion of the cover respectively;

wherein a pair of four bar linkages are defined by the lower arms, the upper arms, the right and left side walls of the shell, and the right and left portions of the cover;

wherein the exterior covering includes at least one shoulder support strap;

wherein the pair of upper arms are joined at a midportion by an upper transverse member and the pair of lower arms are joined at a midportion by an lower transverse member.

2. The backpack according to claim 1 wherein the bottom wall of the shell is substantially planar.

3. The backpack according to claim 1 wherein periphery of the cover includes a water resistant seal, in the closed position the water resistant seal engaging the upper edges of the back wall, the side walls and the front wall.

4. The backpack according to claim 1 comprising a latch releasably connecting the cover to the shell in the closed position.

5. The backpack according to claim 4 wherein the cover is spring biased to an open position when the latch is released.

6. The backpack according to claim 1 wherein the cover includes a storage compartment accessible via an exterior hatch.

7. The backpack according to claim 1 wherein the shell comprises a molded flexible polypropylene.

8. The backpack according to claim 1 wherein the shell has an interior liner made of rip-stop nylon fabric.

9. The backpack according to claim 1 wherein the shell has an exterior covering made of ballistic nylon fabric.

10. The backpack according to claim 9 wherein the shoulder strap is a pair of shoulder support straps adjacent to the back wall of the shell.

11. The back pack according to claim 9 wherein the shell includes a bottle recess in a lower portion of one of: the right side wall and the left side wall.

12. The back pack according to claim 9 wherein the shell includes a storage recess in a lower portion of one of: the right side wall; and the left side wall, and wherein the exterior covering includes a closeable pocket opening adjacent the storage recess.

13. The back pack according to claim 1, wherein the pair of lower arms and the pair of upper arms are releasably mounted to the shell to allow the cover to detach from the shell.

* * * * *